United States Patent [19]

Jacobsen

[11] Patent Number: 4,574,831

[45] Date of Patent: Mar. 11, 1986

[54] APPARATUS FOR SECURING A MANUALLY OPERABLE SETTING ELEMENT AGAINST ROTATION

[75] Inventor: Peter E. Jacobsen, Sonderborg, Denmark

[73] Assignee: Danfoss A/S, Nordborg, Denmark

[21] Appl. No.: 474,713

[22] Filed: Mar. 11, 1983

[30] Foreign Application Priority Data

Mar. 26, 1982 [DE] Fed. Rep. of Germany ..... 3211189

[51] Int. Cl.[4] ..... F17D 1/00

[52] U.S. Cl. ..... 137/382.5; 137/559; 251/292; 292/314

[58] Field of Search ..... 137/382, 382.5, 292, 137/377, 559; 251/208, 209, 231, 292; 292/314, 315, 307 R

[56] References Cited

U.S. PATENT DOCUMENTS 1,982,514 11/1934 Hansen ..... 137/382

2,755,123 7/1956 Percival et al. ..... 292/314

*Primary Examiner*—James C. Yeung

*Assistant Examiner*—Noah Kamen

*Attorney, Agent, or Firm*—Wayne B. Easton

[57] ABSTRACT

The invention relates to a security device which discourages tampering with the operating or control element of a manually settable device of the type which has a window through which the control element is accessed. The security device has the form of a strap which surrounds the housing of the manually settable device and covers the access window. The ends of the strap are permanently connected such that the strap would have to be destroyed to be removed.

5 Claims, 5 Drawing Figures

APPARATUS FOR SECURING A MANUALLY OPERABLE SETTING ELEMENT AGAINST ROTATION

FIELD OF THE INVENTION

The invention relates to an apparatus for use with adjustable flow setting elements for securing a manually operable setting element against rotation.

BACKGROUND OF THE INVENTION

In a known apparatus of this kind (FR-PS No. 1 590 405), an operating element consists of a handwheel which projects from the end of a bearing. The securing member comprises two halves of a clamp that are pulled together by means of two screw connections. The securing member is thereby clamped to the housing of the bearing and, in so doing, locks the handwheel. This construction is costly because two clamping parts and corresponding screw connections are required. Also, the clamping parts must be strong enough to provide operating forces of sufficient magnitude to prevent an adjustment. Nevertheless, it is still possible for unauthorized persons to make an adjustment which can't be detected because the adjustment is facilitated in the course of simply loosening and retightening the screw connections.

OBJECT OF THE INVENTION

It is an object of the present invention to provide an apparatus of the aforementioned kind in which simple means are provided to inhibit the unauthorized adjustment of the operating element or to at least make such adjustment detectable.

The object is achieved according to the invention by (1) the operating element being surrounded by a fixed housing and being accessible and operable only through a circumferential aperture of the housing and (2) the securing member being a strap which covers the circumferential aperture and has strap ends which are permanently interconnected.

GENERAL DISCUSSION OF INVENTION

In this construction, the operating element is not secured against rotation by clamping forces but instead is made inaccessible for making an adjustment. As only the circumferential aperture needs to be covered, a simple strap is sufficient as the securing member. As the ends of the strap are permanently interconnected, the strap must actually be destroyed before an adjustment of the operating element is possible. The destruction of the strap would be readily detectable and this would deter most unauthorized persons from tampering with the strap.

Desirably, the strap is held against lateral displacement by abutments on the housing or the strap such that no clamping forces are required to keep the strap in place over the circumferential aperture. This further simplifies the construction of the strap.

Preferably, the abutments are provided on the strap and project radially inwardly to co-operate with the circumferentially offset ends of the circumferential aperture. This has the additional advantage that the strap is also secured against displacement in the circumferential direction.

Another advantage is that the strap ends are riveted together to provide a simple permanent connection.

In a preferred embodiment, the strap is of a plastic material. This material is satisfactory because no strong forces are applied to the strap and the plastic material is of a nature such that male and female ends may be formed directly thereon which facilitates a riveting form of connection. It is thus possible to make the strap and the parts for the rivet connection as a one-piece injection moulding. The plastic material also permits the strap ends to be connected by cold riveting.

In a preferred embodiment, the strap ends have right-tangle extensions with one extension having a rivet pin formed thereon and the other extension being formed with a complementary hole. The strap is placed about the housing until the rivet pin can be pushed through the hole and the two extensions are in parallel and abutting engagement. Riveting can then be performed.

It is also desireable for the exterior of the rivet pin to have an inclination to simplify the introduction into the hole when the strap is so dimensioned that it closely engages the housing.

With particular advantage, the extension carrying the rivet pin has a well or recess which forms a protective wall which at least partially shields the separation between the extensions. The protective wall prevents the introduction of a knife or the like into the separation and hence prevents destruction of the rivet pin. The strap can thus only be destroyed by cutting through the strap and to do so would require special tools.

It is also an advantage for the strap to be of transparent plastics material and for the part covering the circumferential aperture to be in the form of a magnifying lense. If the operating element has a scale or other lettering in the region of the circumferential aperture, the setting data will then be very visible through the magnifying lense.

BRIEF DESCRIPTION OF DRAWING

The invention will now be described in more detail with reference to an embodiment thereof illustrated in the drawing wherein.

DESCRIPTION OF AN EMBODIMENT OF THE INVENTION

Figure 1:
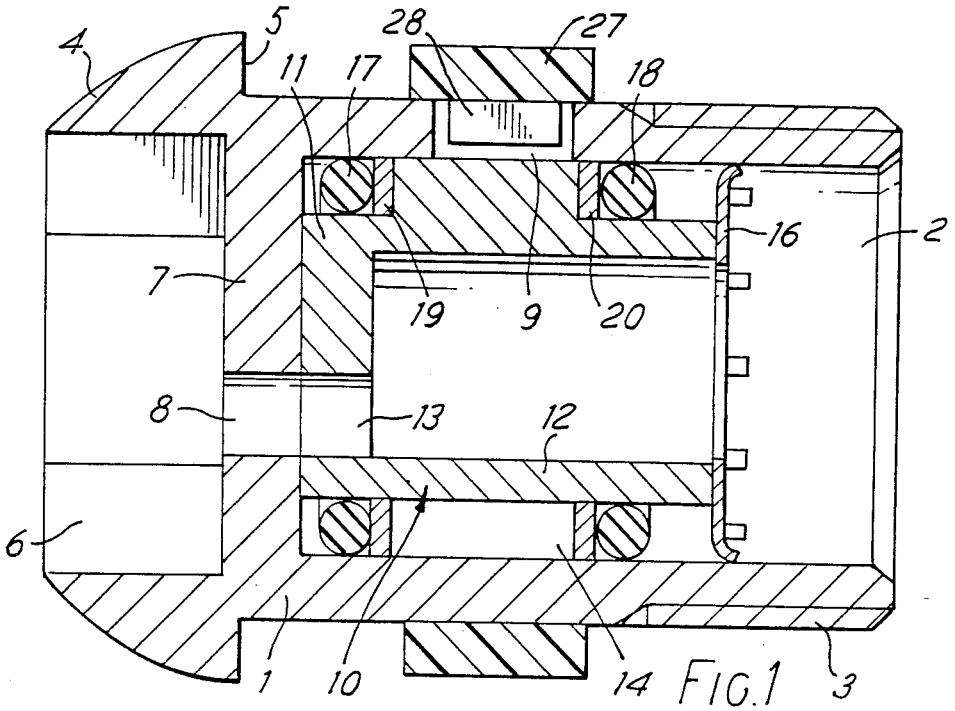
FIG. 1 is a longitudinal section through a securing apparatus according to the invention shown in conjunction with an adjustable throttle element which is accomodated in a connecting nipple for a valve.
Figure 2:
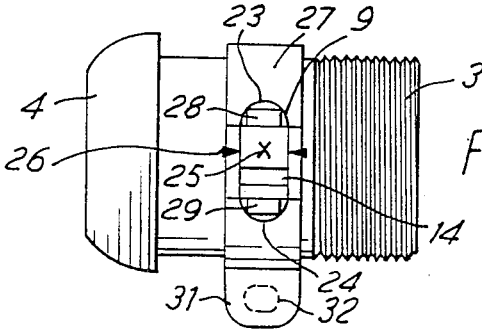
FIG. 2 is a side elevation of the connecting nipple shown to FIG. 1.
Figure 3:
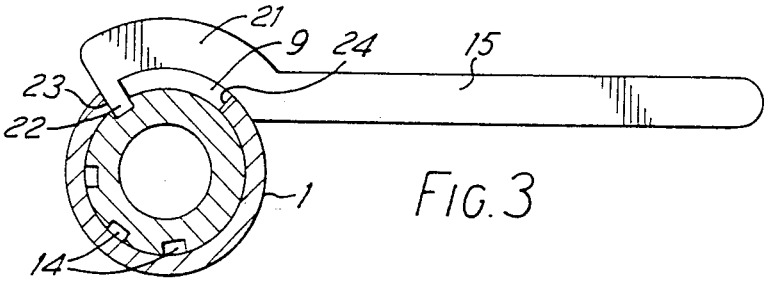
FIG. 3 is a cross-section through the plane of a circumferential aperture of the throttle element shown with a manually-operable tool applied thereto.

The connecting nipple shown in FIGS. 1 to 3 has a nipple body 1 with a cavity 2 which serves as a through-flow passage. The nipple body has an external screwthread 3 and a plug-in section 4 having an annular abutment face 5. The plug-in section has a recessed hexagon 6 formed therein to facilitate the screwing in of the external screwthread 3 of the connecting nipple into an internal screwthread of an adjacent member. The plug-in section 4 may be inserted into a connector of a valve, it being possible to clamp both parts together by means of a coupling nut having an internal flange lying against the annular abutment face 5 of the plug-in section. The nipple body 1 also has a transverse wall 7 with an eccentric throughflow aperture 8 and circumferentially extending aperture 9 which is an essential part of the invention.

An insert 10 in the nipple body cavity 2 jointly comprises a throttle element 11 and an operating element 12. The throttle element 11 is formed by an end wall with an eccentric throughflow aperture 13 and the operating element 12 is formed by a cylindrically shaped section having axial grooves 14 provided at the periphery for engagement therewith of a tool 15. The insert 10 is held against the transverse wall 7 by a clamping plate 16 which frictionally engages the inner cylindrical wall of the cavity 2. At each side of the circumferentially extending aperture there is a sealing ring 17 or 18 and an associated supporting ring 19 or 20.

The tool 15 shown in FIG. 3 is a key with a bent head 21 and a radial tooth 22 which is engageable with one of the axial grooves 14 through the circumferentially extending aperture 9. The pivoting or swinging of the tool 15 while it is supported on the central body 1 causes the insert 10 to rotate. This will in turn cause the rotatable throughflow aperture 13 to move into registry with the fixed throughflow aperture 8 to a greater or less extent to effect a desired setting. Pivotal movement of the tool 15 is limited by the two ends 23 and 24 of the circumferential aperture 9. In addition, insert 10 has a setting data scale 25 in the region of the axial grooves 14 for making settings relative to a marking 26 which is fixed with respect to the housing.

Figure 4:
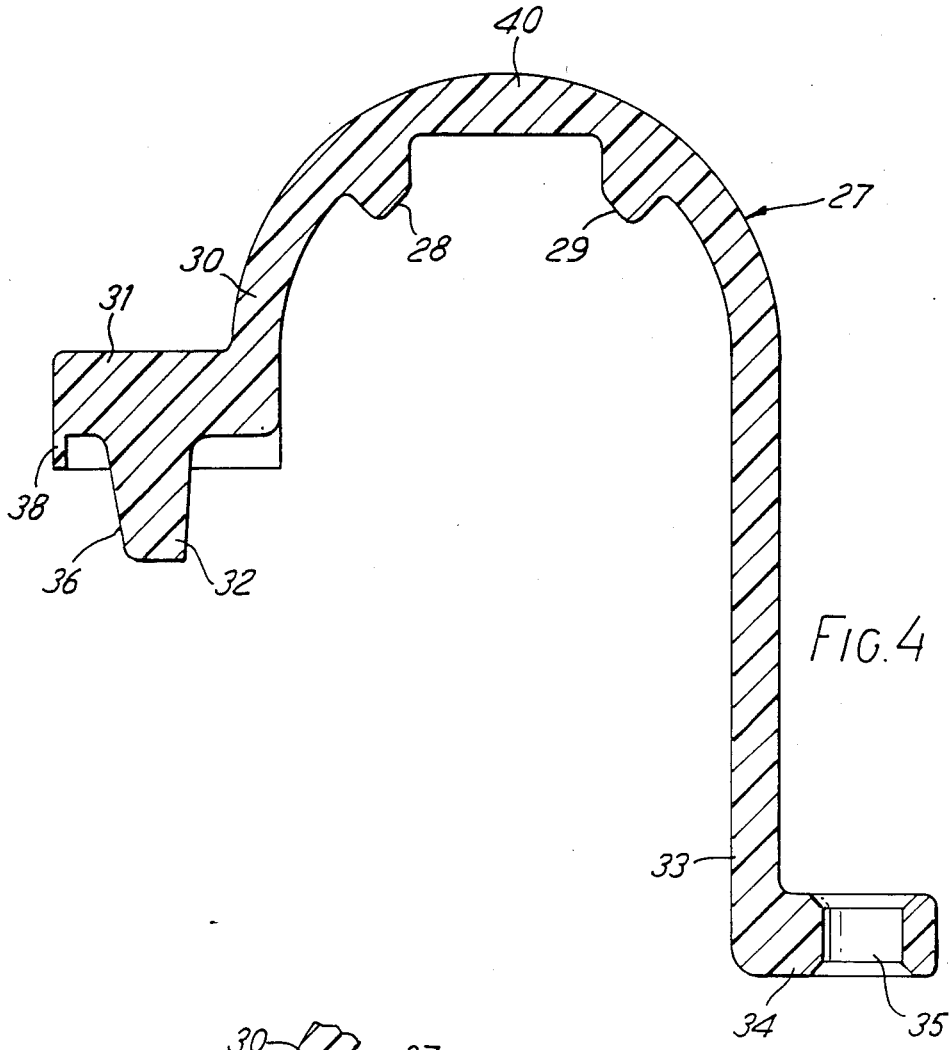
FIG. 4 is a section through a securing strap made according to the invention by injection-moulding.
Figure 5:
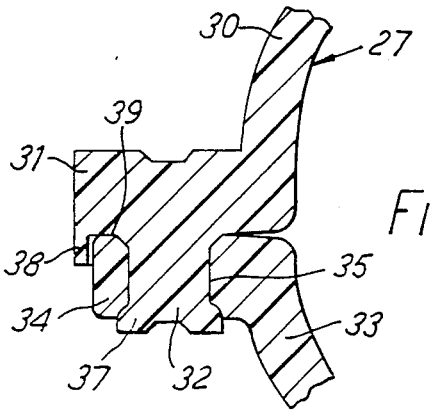
FIG. 5 is a partial section of the strap ends of the strap of FIG. 4 riveted together.

The nipple body 1 is surrounded in the region of the circumferential aperture 9 by a plastic strap 27 which is injection-moulded in the shape shown in FIG. 4. After strap 27 is put in place about the nipple body as shown in FIGS. 1 and 2 it is riveted together at its ends as shown in FIG. 5. Strap 27 has two radially inwardly directed projections 28 and 29 which project into the circumferential aperture 9 and cooperates with the ends 23 and 24 thereof. One end 30 of the strap has a right angle extension 31 having a rivet pin 32 extending in a normal direction therefrom. The other end 33 of the strap has a right angle extension 34 having a hole 35 for receiving the rivet pin 32. On its outer side the rivet pin has an inclination 36 but is otherwise cylindrical. The axial length of pin 32 is about 1.5 mm longer than that of the hole 35 to facilitate the forming of a rivet head 37 as shown in FIG. 5. In addition, the extension 31 has a protective wall 38 formed thereon which surrounds the abutting faces 30 between the two extensions 31 and 34 over the largest segments of their peripheries. Strap 27 is mde of a transparent plastic material such as polyamide PA, for example. The strap portion between abutments 28 and 29 is somewhat thicker and has the form of a magnifying lense 40. In this way the marking 25 of the scale, and thus the setting of the insert 10, is more easily visible.

In operation, the tool 15 is used to rotate the insert 10 to a desired position, after the nipple is installed in a heating system, for example. The abutments 28 and 29 of the strap 27 lock the strap in its illustrated position relative to circumferential aperture 14 and the two strap ends are brought together and permanently connected by cold welding. As a coupling unit must be brought into position against annular face 5 before the strap 27 is applied, the loss of the coupling nut will be prevented even before the nipple is installed. Thereafter the adjustment of the insert 10 is possible only after strap 27 is destroyed. This would require the application of considerable forces with the aid of a special tool because the entire corss section of the strap would have to be severed. Finally, the protecting wall 38 protects pin 32 from being severed without removing or cutting through the protecting wall to do so.

I claim:

1. A tamper-proof adjustable control unit, comprising, a housing having a bore, a rotatably adjustable operating element rotatably mounted in said bore, said operating element presenting different control values for different circumferential settings thereof, a circumferentially extending aperture in said housing spaced axially between the ends of said operating element, setting means on said operating element accessible only through said aperture for rotating said operating element to a desired circumferential setting, strap means surrounding said housing and covering said circumferentially extending aperture, said strap means having permanently connectable ends to prevent removal thereof without being subject to destruction, and two inwardly extending projections on said strap means which engage the opposite ends of said circumferentially extending aperture to prevent lateral displacement of said strap means.

2. A unit according to claim 1 wherein said strap means ends are riveted together.

3. A unit according to claim 2 wherein said strap means ends have right angle extensions with adjacent faces in abutting engagement when said strap means is in an installed position, one of said extensions having a rivet pin and the other of said extensions having a complementary hole for receiving said rivet pin.

4. A unit according to claim 3 wherein said extension carrying said rivet pin has a protective wall which sufficiently surrounds said adjacent faces of said extension to prevent access to said pin with a cutting device without mutilating said wall.

5. A unit according to claim 1 wherein said strap means is of a transparent material plastics material and the part covering said circumferentially extending aperture has means to magnify images and includes a convex wall.

* * * * *